United States Patent [19]

Shy et al.

[11] 4,270,900

[45] Jun. 2, 1981

[54] SUSPENSION PREHEATER

[75] Inventors: James L. Shy, East Troy; Paul D. Hess, Brookfield, both of Wis.

[73] Assignee: Allis-Chalmers Corporation, Milwaukee, Wis.

[21] Appl. No.: 110,255

[22] Filed: Jan. 7, 1980

[51] Int. Cl.[3] ..... F27B 15/00; F27B 7/02

[52] U.S. Cl. ..... 432/58; 432/106

[58] Field of Search ..... 432/14, 15, 16, 58, 432/106

[56] References Cited

U.S. PATENT DOCUMENTS

| | | | |
|---|---|---|---|
| 3,265,775 | 8/1966 | Friedrich | 432/15 |
| 3,364,583 | 1/1968 | Friedrich | 432/16 |
| 3,364,589 | 1/1968 | Muller | 432/58 |
| 3,692,287 | 9/1972 | Kohl et al. | 106/100 |
| 3,904,353 | 9/1975 | Bosshard et al. | 432/106 |
| 4,063,875 | 12/1977 | Takeuchi | 432/16 |
| 4,088,438 | 5/1978 | Deussner et al. | 432/106 |
| 4,191,526 | 3/1980 | Triebel | 432/106 |
| 4,209,296 | 6/1980 | Deussner | 432/106 X |

*Primary Examiner*—John J. Camby

*Attorney, Agent, or Firm*—Arthur M. Streich

[57] ABSTRACT

A suspension preheater adapted to be connected to the feed end housing of a rotary kiln or the like, whereby kiln exhaust gas emerging from the feed end housing passes through the preheater in countercurrent heat exchange relation with particulate feed material for the kiln which passes through the preheater from a feed inlet end contiguous the upper end of the preheater to a feed discharge end at the lower end of the preheater, comprising one or more cyclone means arranged in series gas and particulate feed material flow relation with respect to each other, means for admitting the particulate feed material from a feed material supply source to the upper portion of the preheater, a hollow preheating chamber at the lower portion of the suspension preheater, the hollow preheating chamber having the upper end thereof in gas and material flow communication with the upper end of the lowermost of the cyclone means, the lower end of the hollow preheating chamber being in gaseous flow communication with the feed end housing of the rotary kiln, a first particulate material delivery pipe connecting the lower portion of the lowermost cyclone means to the interior of the hollow preheating chamber intermediate the height of the preheating chamber, and a second particulate material delivery pipe connecting the lower portion of the lowermost cyclone means directly to the interior of the feed end housing of the kiln.

3 Claims, 4 Drawing Figures

SUSPENSION PREHEATER

TECHNICAL FIELD

This invention relates to a suspension preheater of the type used to preheat finely divided particulate material such as the feed or "meal" which is being fed to the inlet end of a cement kiln, a lime kiln, or the like. While the suspension preheater of the invention will be described as used in connection with a cement kiln, it is not restricted to such use.

BACKGROUND OF THE PRIOR ART

In the manufacture of cement using a rotary cement kiln, it is known to position a suspension type preheater contiguous the feed end of the kiln and to direct the exhaust gases from the rotary kiln through the suspension type preheater in countercurrent flow direction with respect to the flow of the feed or "meal" which is in finely divided particulate form, whereby to preheat the meal and to decarbonize a portion of certain constituents such as calcium carbonate ($CaCO_3$) and magnesium carbonate ($MgCO_3$) prior to the entry of the meal into the kiln. In the case of a cement kiln, the "meal" also contains compounds of silicon, iron, and aluminum, all of which undergo various chemical reactions during the course of the heat treatment process in the rotary kiln into which the "meal" is discharged from the suspension preheater. The end product produced by the heat treatment process in the kiln is cement.

Examples of prior art patents showing use of suspension type preheaters for use in the heat treatment of finely subdivided particulate material include the following U.S. Pat. Nos. 3,265,775 issued to Wolfgang Friedrich on Aug. 9, 1966; 3,364,583 issued to Wolfgang Friedrich on Jan. 23, 1968; and 4,063,875 issued to Masaaki Takeuchi on Dec. 20, 1977.

Several problems have been encountered in the operation of suspension type preheaters of the general type disclosed by the aforementioned U.S. Pat. Nos. 3,265,775 and 3,364,583 to Wolfgang Friedrich. These problems may be enumerated as follows:

(1) In a suspension preheater constructed in accordance with the principles of the aforementioned two prior art Friedrich patents, the preheated meal is discharged from the lowermost twin cyclones (i.e.—third stage cyclones) into the interior of the fourth-stage preheating chamber such as a conical shaft at a location approximately at the mid-point of the height of the fourth-stage conical shaft. The "meal" thus discharged into the fourth-stage conical shaft is entrained by high velocity exhaust gas from the rotary kiln, which gas is passing upwardly through the fourth-stage conical shaft in countercurrent flow relation to the inlet meal which is discharging downwardly from the third stage cyclones. A relatively large quantity of the powder-like meal (in fact, a relatively large oversupply of the "meal") must be supplied to and maintained in the fourth-stage conical shaft to overcome the upward thrust of the high velocity exhaust gas and to thus establish a meal flow out of the bottom of the fourth-stage conical shaft. This, in turn, causes an undesirably high degree of gaseous entrainment of the "meal" in the lower portion of the fourth-stage conical shaft and also in the feed end housing of the rotary kiln to which the lower end of the fourth-stage conical shaft is connected. The various factors just described produce an undesirable recirculation of the "meal" between the feed end housing and the suspension preheater and between the fourth-stage conical shaft and the third-stage cyclones, causing an undesirable high pressure drop across the suspension type preheater. This high pressure drop of the kiln gas across the preheater requires use of a higher pressure exhaust fan, with consequent greater capital investment and greater expenditure of energy. This recirculation of the meal also increases the preheater offgas temperature thereby causing undesirable thermal losses.

(2) If the prior art Friedrich preheater is used in conjunction with a system in which a portion of the kiln exhaust gas is extracted or bypassed from the kiln feed end housing for control of the alkali level of the product clinker, the high degree of meal concentration in the kiln exhaust gas at the point of the bypass extraction causes a large quantity of meal to be extracted along with the bypass gas. The loss of this feed represents an economic penalty associated with bypass operation when using a suspension type preheater arrangement of the type shown in the aforementioned United States patents to Friedrich.

(3) It has been known in connection with suspension preheaters of the type shown by the aforementioned Friedrich patents to provide a fuel burner on the interior of the preheating chamber such as the hollow conical shaft at the lower portion of the suspension preheater for the purpose of increasing the level of calcination of the meal, with consequent increased cement clinker production. However, this has not proven to be successful in the case of suspension preheaters of the prior art Friedrich type due to the fact that the high concentration of "meal" in the conical shaft has provided a very poor environment and atmosphere for combustion and therefore, to the best of our knowledge, prior art attempts to employ a fuel burner in the conical shaft of prior art Friedrich preheaters have been abandoned.

STATEMENT OF THE INVENTION

Accordingly, it is an object of the present invention to provide an improved suspension preheater construction of the type having a hollow preheating chamber such as a conical shaft at the lower portion of the preheater which is adapted to be connected to the feed end housing of a rotary cement kiln, lime kiln, or the like and in which gaseous entrainment of "meal" in the conical shaft and in the kiln feed end housing is drastically reduced, which in turn reduces recirculation loops between the feed end housing and the fourth-stage conical shaft of the suspension preheater, and between the fourth-stage conical shaft and the third stage cyclones, with consequent reduced pressure drop of the kiln exhaust gas across the suspension preheater as compared to the pressure drop across a prior art suspension preheater of the same general type. The reduced pressure drop made possible by the present invention permits use of an exhaust fan of lower pressure rating than has been used with prior art suspension preheaters of the same general type, with consequent saving in capital investment and in expenditure of energy, and with increased cement clinker production from a given size kiln preheater system.

It is a further object of the invention to provide a suspension preheater of the type including one or more vertically superposed cyclone stages and a hollow preheating chamber such as a hollow conical shaft at the lower portion of the preheater, and adapted for connection to the feed end housing of a rotary cement kiln, a lime kiln, or the like, which thermal studies indicate may reduce the preheater off gas temperature with a consequent saving in energy, and with a consequent reduction in the heat load in the kiln with resulting increase in the life of the kiln firebrick.

It is still a further object of the invention to provide a suspension preheater of the type including one or more vertically superposed cyclone stages and a hollow preheating chamber such as a hollow conical shaft stage at the lower portion of the preheater, and which is adapted to provide a suitable combustion atmosphere for a fuel burner mounted within the conical shaft stage.

It is still a further object of the invention to provide a suspension preheater of the type including one or more vertically superposed cyclone stages and a hollow preheating chamber such as a hollow conical shaft stage at the lower portion of the preheater, and adapted for connection to the feed end housing of a cement kiln, a lime kiln, or the like, and which includes means for controlling the concentration of the "meal" in the conical shaft and in the feed end housing of the kiln.

It is a further object of the invention to provide a suspension preheater for connection to the feed end of a rotary cement kiln, a lime kiln, or the like which results in lower concentrations of gaseous entrained "meal" in the feed end housing, thereby making economically feasible the extraction of kiln exhaust gas from the kiln feed end housing without the loss of "meal" and of dust in the gas stream at the point of bypass extraction.

In achievement of these objectives, there is provided in accordance with the invention a suspension preheater adapted to be connected to the feed end housing of a rotary kiln or the like, whereby kiln exhaust gas emerging from said feed end housing passes through said preheater in countercurrent heat exchange relation with particulate feed material for said kiln which passes through said preheater from a feed inlet end contiguous the upper end of said preheater to a feed discharge end at the lower end of said preheater, comprising one or more vertically superposed cyclone means arranged in series gas and particulate feed material flow relation with respect to each other, means for admitting the particulate feed material from a feed material supply source to the uppermost of said cyclone means, a hollow preheating chamber at the lower portion of said suspension preheater, said hollow preheating chamber having the upper end thereof in gas and material flow communication with the upper end of the lowermost of said cyclone means, the lower end of said hollow preheating chamber being in gaseous flow communication with said feed end housing of said rotary kiln, a first particulate material delivery pipe connecting the lower portion of said lowermost cyclone means to the interior of said hollow preheating chamber intermediate the height of said preheating chamber, and a second particulate material delivery pipe connecting the lower portion of said lowermost cyclone means directly to the interior of said feed end housing.

Further objects and advantages of the invention will become apparent from the following description taken in conjunction with the accompanying drawings in which:

BRIEF DESCRIPTION OF THE DRAWINGS

FIG. 1 is an elevation view, partially schematic, of a prior art suspension preheater of the general type shown by U.S. Pat. Nos. 3,265,775 and 3,364,583, showing the suspension type preheater connected to the feed end housing of a rotary cement kiln or the like;

DESCRIPTION OF THE PRIOR ART SUSPENSION PREHEATER CONSTRUCTION

Figure 1:
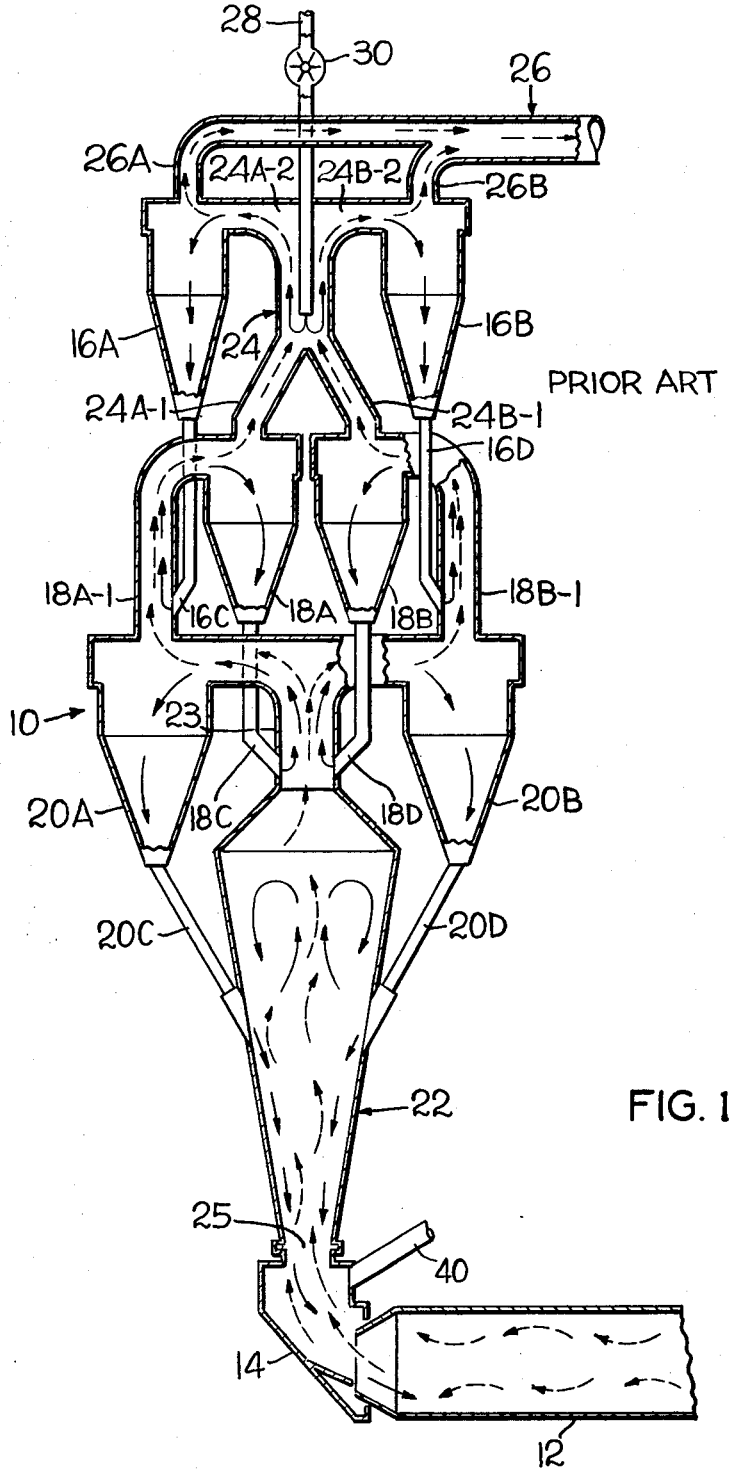

Referring now to FIG. 1, there is shown a prior art suspension preheater generally indicated at 10 and based upon the principles set forth in the aformentioned prior art U.S. Pat. Nos. 3,265,775 and 3,364,583 to Wolfgang Friedrich. The lower end of suspension preheater 10 communicates with the feed end housing 14 of a rotary cement kiln generally indicated at 12. Suspension preheater 10 includes a pair of parallel connected first-stage cyclones 16A and 16B positioned above a pair of parallel connected second-stage cyclones 18A and 18B which, in turn, are positioned above a pair of parallel connected third-stage cyclones 20A and 20B. The suspension preheater also comprises a hollow preheating chamber 22 which in the illustrated embodiment is a hollow conical shaft. Conical shaft 22 defines the fourth-stage of the suspension preheater and extends downwardly below third-stage cyclones 20A, 20B, the lower end of fourth-stage conical shaft 22 being connected to the feed inlet end of feed end housing 14 of rotary cement kiln 12. The passage between feed end housing 14 and conical shaft 22 is indicated at 25.

A duct generally indicated at 24 is positioned at substantially the same height as first-stage cyclones 16A, 16B intermediates the two parallel connected first-stage cyclones. Duct 24, at its lower portion, is bifurcated into two duct passages 24A-1 and 24B-1 which respectively are in fluid communication with the upper ends of the respective second-stage cyclones 18A and 18B. The upper end of duct 24 is provided with two diverging passages 24A-2 and 24B-2 which are in fluid communication with the upper ends of the respective first-stage cyclones 16A and 16B. Duct portions 24A-2 and 24B-2 are also in fluid communication with exhaust duct portions 26A and 26B which are respectively in communication with main exhaust duct 26.

A feed pipe 28 controlled by a valve 30 extends downwardly into the interior of the upper portion of duct 24 and raw meal, in finely divided, powder-like form and containing the calcium carbonate, magnesium carbonate and other chemical ingredients required in the manufacture of cement (assuming kiln 12 is a cement kiln), is introduced into duct 24 through feed pipe 28 to the upper end of the suspension preheater. The flow of particulate material is indicated by the full line arrows in FIGS. 1 and 2.

The lower ends of the respective first-stage cyclones 16A and 16B are connected by meal pipes 16C and 16D to the lower portions of gas ducts 18A-1, 18B-1 which rise upwardly from the upper ends of the respective third-stage cyclones 20A and 20B. The lower ends of the respective second-stage cyclones 18A and 18B are provided with meal pipes 18C and 18D, respectively, which discharge meal from the lower ends of the respective second-stage cyclones 18A and 18B into duct 23 which connects the upper end of conical shaft 22 to the upper end of cyclones 20A, 20B.

Meal pipes 20C and 20D of substantially equal length as each other connect the lower ends of the respective third-stage cyclones 20A and 20B with the interior of fourth-stage hollow conical shaft 22 at a location approximately at the mid-point of the vertical height of conical shaft 22.

Duct 23 connects the upper end of fourth-stage conical shaft 22 in fluid and material flow communication with the upper ends of third stage cyclones 20A and 20B and also in fluid flow communication with gas ducts 18A-1 and 18B-1.

In the operation of the prior art suspension preheater shown in FIG. 1, the exhaust gas indicated by the dashed line arrows exits from the feed end of kiln 12 and enters feed end housing 14 in counterflow heat exchange relation to the "meal" entering feed end housing 14. The gas thence passes vertically upwardly through fourth-stage conical shaft 22 and through duct 23 into the upper end of the two parallel third-stage cyclones 20A and 20B. The gas thence passes upwardly through the oppositely disposed gas ducts 18A-1 and 18B-1 associated with parallel connected second-stage cyclones 18A and 18B. The gas then passes across the upper portions of second-stage cyclones 18A and 18B and upwardly through the bifurcated duct portions 24A-1 and 24B-1 contiguous first-stage cyclones 16A and 16B. The gas then passes through the upper portion of duct 24 and across the upper ends of first-stage cyclones 16A and 16B, and thence outwardly through exit duct portions 26A and 26B to exhaust duct 26. The gas in passing through duct 24 entrains the "meal" emerging from meal inlet pipe 28 and causes it to be precipitated downwardly into first-stage cyclones 16A and 16B. The meal exits from cyclones 16A and 16B through meal pipes 16C and 16D and enters gas ducts 18A-1 and 18B-1 associated with second-stage cyclones 18A and 18B. The meal entering gas ducts 18A-1 and 18B-2 is entrained by the upwardly passing gas and is precipitated downwardly into and through second-stage cyclones 18A and 18B. The meal then passes downwardly through meal pipes 18C and 18D into duct 23 where the meal is entrained by the upwardly moving gas emerging from the upper end of fourth-stage conical shaft 22. The mixture of meal and gas passes outwardly from the upper end of duct 23, with the meal being precipitated downwardly through third-stage cyclones 20A and 20B, and passing outwardly from third-stage cyclones 20A, 20B and through the two oppositely disposed meal pipes 20C and 20D into the lower portion of the interior of fourth-stage conical shaft 22. Theoretically, the meal then passes downwardly in heat exchange relation with the gas in conical shaft 22 and exits into feed end 14 of kiln 12 and thence passes into the interior of kiln 12.

In the operation of suspension preheater 10 of FIG. 1, the kiln exit gas moves in a direction countercurrent to the direction of flow of feed in kiln 12 and exits into feed end housing 14 of the kiln at a high velocity. The high velocity exhaust gas recirculates most of the suspended meal in feed end housing 14 back into fourth-stage conical shaft 22.

A bypass pipe 40 communicates with the interior of feed end housing 14 to bypass a predetermined volume of the exhaust gas in feed end housing 14 and to conduct such bypass gas to a bypass system which may be used for any desired purpose such as reducing the clinker (the cement end product) alkali level or to prevent operational problems of build-up or plugging of preheater 10. The details of the bypass system form no part of the present invention. However, when a bypass system is employed, with a portion of the kiln exhaust gas being extracted from the kiln feed end housing 14 and processed through the bypass system, the "meal" or dust in the bypass gas is partially or totally wasted depending upon the specific bypass system to which bypass duct 40 is connected.

Figure 2:
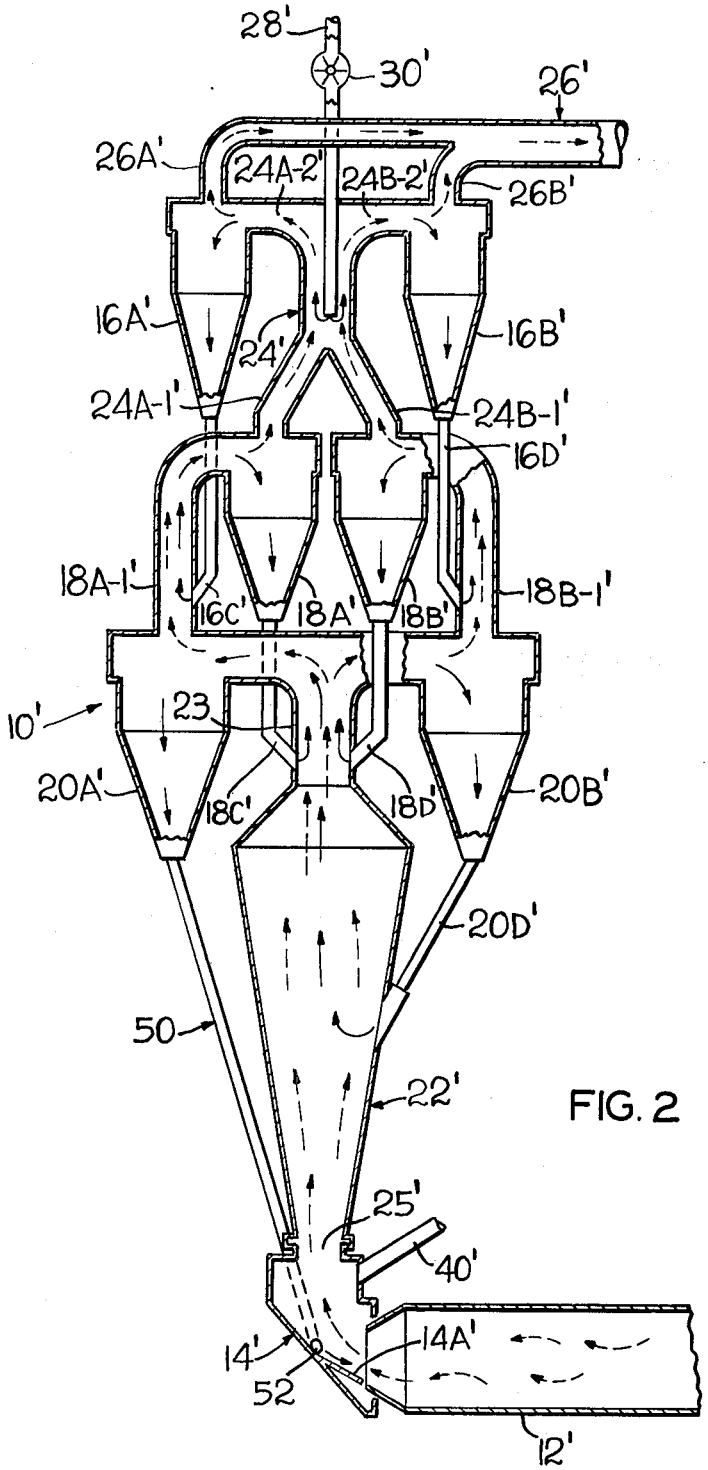
FIG. 2 is a view of a suspension preheater generally similar to that shown in FIG. 1, but in which the "meal" pipe from one of the two parallel-connected third-stage cyclones has been rerouted, as compared to the embodiment of FIG. 1, whereby the aforementioned meal pipe discharges directly into the feed end housing of the associated rotary kiln rather than into the fourth-stage conical shaft of the suspension preheater.

Referring now to FIG. 2, which shows the modified construction in accordance with the invention, the preheater generally indicated at 10' is similar in all respects to the preheater 10 shown and described in connection with FIG. 1, except for one change which will now be described. In the embodiment of FIG. 2, similar parts have the same reference numeral as in the embodiment of FIG. 1 except that corresponding reference numerals of FIG. 2 are primed (').

In the modified embodiment of FIG. 2, meal pipe 20C of FIG. 1 has been replaced by a meal pipe indicated at 50 in FIG. 2. Meal pipe 50 conducts the meal from the lower end of third-stage cyclone 20A' directly to the interior of feed end housing 14'. The discharge end 52 of meal pipe 50 is positioned closely contiguous the ramp surface 14A' in the lower portion of feed end housing 14', whereby the meal discharged from discharge end 52 of meal pipe 50 slides directly into the inlet or feed end of rotating kiln 12, thereby minimizing gaseous entrainment of the meal. Meal pipe 20D' from the oppositely disposed third-stage cyclone 20B' remains unchanged in position from the embodiment of FIG. 1. The meal from the lower end of oppositely disposed cyclone 20B' is directed into the hollow interior of fourth-stage hollow preheating chamber defined by conical shaft 22 intermediate the height of shaft 22 and in substantially the same discharge location in conical shaft 22 as in the embodiment of FIG. 1.

In the operation of the modified embodiment of FIG. 2, the quantity of meal suspended or in gaseous entrainment in feed end housing 14' is greatly reduced as compared to the embodiment of FIG. 1. Furthermore, bypass gas extracted from feed end housing 14' through duct 40' in the embodiment of FIG. 2 is relatively free of raw meal and dust, thereby substantially eliminating the economic loss associated with bypass operation in the embodiment of FIG. 1.

In the embodiment of FIG. 2, it is desirable to maintain a certain quantity of meal in conical shaft 22' for heat transfer from the kiln exhaust gas and for meal calcination. However, it is undesirable to do this with a high concentration of meal in conical shaft 22' such as existed in the constructions of the prior art Friedrich patents. Cyclone 20B' and meal pipe 20D' serve the function of introducing an acceptable quantity of meal into the interior of conical shaft 22' for heat exchange with the kiln exhaust gas and for calcination.

All of the mea' introduced to conical shaft 22' from third stage cyclone 20B' through meal pipe 20D' is carried outwardly through the upper end of conical shaft 22' by the upwardly moving gas stream, with the upwardly moving meal ultimately being delivered to the interior of feed end housing 14' through meal pipe 50. Substantially no meal discharges through the passage 25' from conical shaft 22' into feed end housing 14. Meal pipe 50 provides a "bypass" around fourth-stage conical shaft 22' through which substantially all of the meal from third-stage cyclones 20A' and 20B' is ultimately delivered to feed end housing 14' of rotary kiln 12'.

The meal recirculation cycle between feed end housing 14 and conical shaft 22 and between conical shaft 22 and third-stage cyclone 20 which prevails in the prior art embodiment of FIG. 1 is essentially eliminated in the embodiment of of FIG. 2. The reduction of the recycling of the meal in the embodiment of FIG. 2, as compared to the prior art embodiment of FIG. 1, as just described, results in a drastically reduced meal concentration in conical shaft 22' and in feed end housing 14' which results in a greatly reduced pressure drop across those components, namely, feed end housing 14'; conical shaft 22'; and third-stage cyclone 20, in the embodiment of FIG. 2. The resulting reduced pressure drop in the components just mentioned, permits the use of an exhaust fan of substantially lower pressure than in the prior art embodiment of FIG. 1, with resulting substantially lower energy consumption as compared to the prior art embodiment of FIG. 1.

Figure 2A:
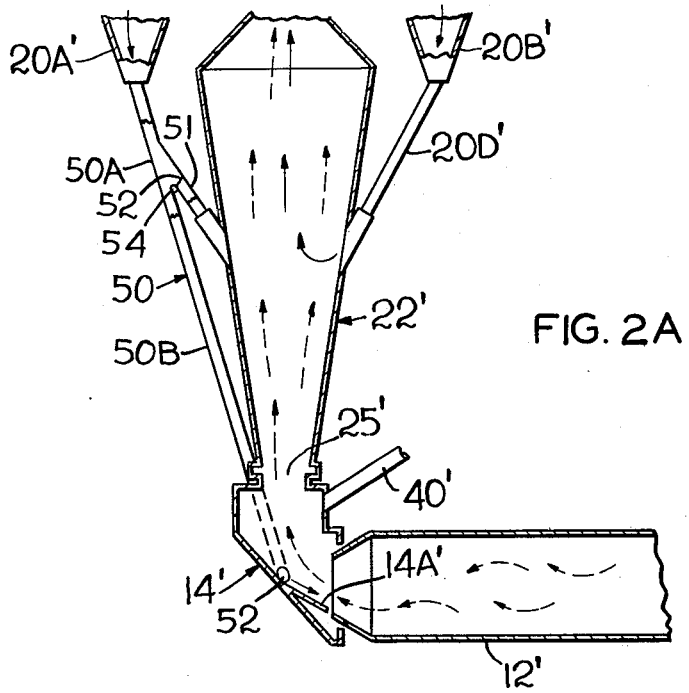
FIG. 2A is a fragmentary view of a modified arrangement in which one of the two parallel connected third-stage cyclones is connected by two parallel-connected meal pipes respectively to the kiln feed end housing and also to the interior of the fourth-stage conical shaft, with valve means for controlling the proportion of the meal which flows through the respective parallel-connected pipes.

The modified embodiment shown in FIG. 2A is similar to the embodiment of FIG. 2 except for the changes which will be described hereinafter. In the modified embodiment of FIG. 2*a*, a meal pipe, generally indicated at 50 is connected at its upper end to the lower end of third-stage cyclone 20A' and at its lower end to the interior of feed end housing 14' of kiln 12', in the same manner as shown in FIG. 2. An auxiliary meal pipe 51 communicates with the upper portion 50A of meal pipe 50 through a control valve 52. The lower end of auxiliary meal pipe 51 discharges into the interior of conical shaft 22' at substantially the same height as the oppositely disposed meal pipe 20D' which discharges meal from cyclone 20D'.

Control valve 52 which is diagrammatically indicated as a flap valve is pivoted at point 54 and can be swung to one extreme position in which it closes the upper end of auxiliary meal pipe 51 so that no meal passes through meal pipe 51, and all of the meal discharged from cyclone 20A' passes through the lower portion 50B of meal pipe 50 directly to kiln feed housing 14'. Valve 52 can also be swung to an opposite extreme position in which it prevents any passage of meal through the lower portion 50B of meal pipe 50 beneath valve 52, and in this extreme position of pivoted valve 52, all of the meal passed through auxiliary meal pipe 51 into the interior of conical shaft 22'.

Pivoted valve 54 may also be moved to an intermediate position between the two extreme positions just described, in order to obtain a desired proportioning of the meal flow through the lower portion 50B of meal pipe directly to feed end housing 14' and through auxiliary meal pipe 51 to the interior of conical shaft 22'.

Figure 2B:
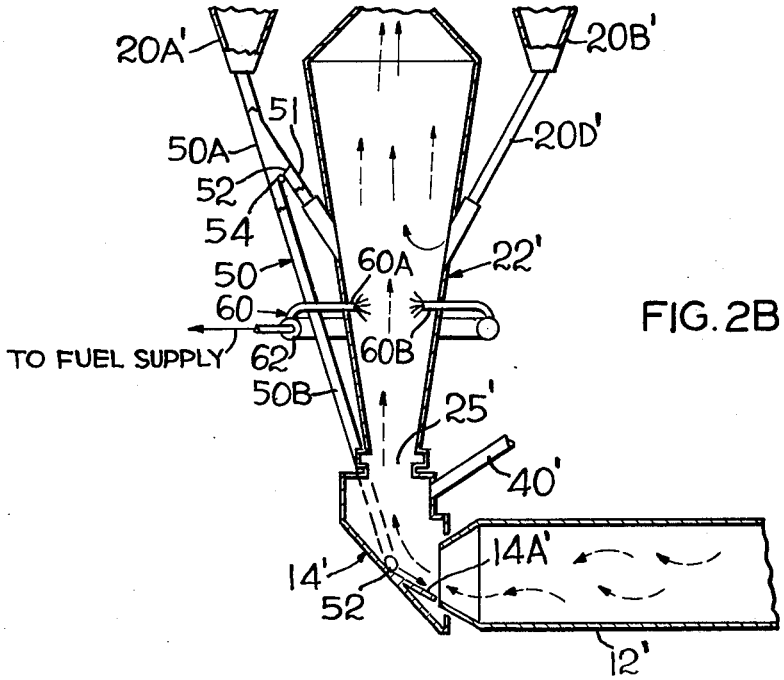
FIG. 2B is a fragmentary view in elevation, partially broken away, of a modified embodiment in accordance with FIG. 2 in which a fuel burner is mounted on the interior of the fourth-stage conical shaft.

There is shown in FIG. 2B a modified arrangement in which the suspension preheater arrangement and its relation to the rotary kiln are the same as shown in FIG. 2A, including a meal bypass pipe 50 from third-stage cyclone 20A' directly to feed end housing 14', an auxiliary meal pipe 51, connected to the interior of conical shaft 22', and a valve 52 for proportioning meal flow through section 50B of meal pipe 50 and through auxiliary meal pipe 51. In FIG. 2B a fuel burner diagramatically indicated at 60 and including a plurality of fuel burner nozzles 60A, 60B, is mounted on the interior of the lower portion of hollow conical shaft 22'. Nozzles 60A, 60B are connected to a fuel supply manifold 62 which, in turn, is connected to a suitable source of fuel supply. Any suitable fuel may be used, such as a liquid, gaseous or solid hydrocarbon, or other suitable fuel. Fuel burner 60 supplies heat to the meal inside conical shaft 22', to increase the level of calcination of the meal and to increase the output product of kiln 12'. The use of fuel burner 60 inside conical shaft 22' reduces the heat load in kiln 12', with a consequent increase in the life of the firebrick in kiln 12'. The use of fuel burner 60 is practical because of the low concentration of meal in conical shaft 22', due to the provision of meal bypass pipe 50, which provides an environment inside conical shaft 22' which sustains the flame of burner 60.

While burner 60 has been shown in connection with a suspension preheater arrangement similar to that shown in FIG. 2A, having both meal bypass pipe 50 and also auxiliary meal pipe 51, the fuel burner 60 can also be used with a suspension heater arrangement such as that shown in FIG. 2 which employs meal bypass pipe 50 without auxiliary meal pipe 51.

From the foregoing detailed description of the invention, it has been shown how the objects of the invention have been obtained in a preferred manner. However, modifications and equivalents of the disclosed concepts such as readily occur to those skilled in the art are intended to be included within the scope of this invention.

The embodiments of the invention in which an exclusive property or privilege is claimed are defined as follows:

1. A particulate material furnacing system including:

(a) a tubular rotary kiln (12) defining on one end thereof a circular opening for admitting feed material to said kiln and discharging exhaust gases from said kiln;

(b) a stationary feed end housing (14) with an opening surrounding the feed inlet end of said kiln with a feed ramp (14A) mounted within said housing to slope downwardly to a lower end adjacent to a lower portion of said feed inlet end of said kiln;

(c) a suspension preheater (10) mounted on top of said feed end housing (14) with said preheater having a hollow shaft (22) arranged with a central axis therethrough in a vertical position and the lower end (25) of the shaft connected to the feed end housing (14);

(d) a bypass pipe (40) communicating with the interior of feed end housing (14) through an opening in the kiln facing side of said housing and spaced above the feed inlet end of said kiln to bypass a portion of the exhaust gas discharged from upper regions within said kiln (12) around said preheater (10);

(e) a material preheating stage comprising a pair of cyclone separators (20A, 20B) and having gas flow conduit means (23) connected to deliver gas from the top of said shaft (22) to each of said separators (20A, 20B);

(f) particulate material delivery means (18C) connected to discharge material into said conduit means (23);

(g) a first particulate material delivery pipe (20D) connecting a material discharge opening of one of said pair of cyclone separators (20B) to the interior of the shaft (22) intermediate its upper and lower ends; and the improvement comprising:

(h) a second particulate material delivery pipe (50) connecting a material discharge opening of the other of said pair of cyclone separators (20A) to the housing (14) with said second pipe (50) terminating at an opening (52) in said housing located adjacent the upper surface of said feed ramp (14A') and spaced both horizontally away from said kiln (12) and vertically below said bypass pipe (40) to discharge feed material on to said feed ramp (14A') and into the kiln (12) below and away from the upper layers of kiln gases passing into said bypass pipe (40), to minimize feed material loss through said bypass pipe (40).

2. A particulate material furnacing system as defined in claim 1 in which said hollow shaft (22) for a major portion of its height above the housing (14), is a configuration that is conical with an apex end extending downwardly to the feed end housing (14).

3. A particulate material furnacing system as defined in claim 1 in which a third particulate material delivery pipe (51) is connected to said second pipe (50), said third particulate material delivery pipe (51) being connected in discharging relation to the interior of said hollow shaft (22) intermediate the upper and lower ends thereof, and valve means (52) for proportioning the flow of particulate material through said second and said third pipes (50B, 51) with respect to each other.

* * * * *